US008517656B2

(12) United States Patent
Hartshorne et al.

(10) Patent No.: US 8,517,656 B2
(45) Date of Patent: Aug. 27, 2013

(54) COVER APPLIER AND METHOD OF ALIGNING A BOOK IMAGE TO A COVER IMAGE

(75) Inventors: John Hartshorne, Newmarket, NH (US); Glenn Alan Guaraldi, Kingston, NH (US); Charles Reif Hammond, Durham, NH (US)

(73) Assignee: Goss International Americas, Inc., Durham, NC (US)

( * ) Notice: Subject to any disclaimer, the term of this patent is extended or adjusted under 35 U.S.C. 154(b) by 192 days.

(21) Appl. No.: 12/984,236

(22) Filed: Jan. 4, 2011

(65) Prior Publication Data

US 2011/0170987 A1 Jul. 14, 2011

Related U.S. Application Data

(60) Provisional application No. 61/293,398, filed on Jan. 8, 2010.

(51) Int. Cl.

| | |
|---|---|
| ***B42C 11/00*** | (2006.01) |
| ***B42C 13/00*** | (2006.01) |
| ***B42C 11/02*** | (2006.01) |
| ***B42C 11/04*** | (2006.01) |
| ***B42B 9/00*** | (2006.01) |

(52) U.S. Cl.
USPC ..... 412/11; 412/4; 412/5; 412/13; 412/18; 412/19; 412/20; 412/21

(58) Field of Classification Search
USPC ..... 412/4, 5, 11, 13, 18–21
See application file for complete search history.

(56) References Cited

U.S. PATENT DOCUMENTS

| | | | | |
|---|---|---|---|---|
| 5,874,812 | A | 2/1999 | Chang | |
| 6,193,458 | B1 | 2/2001 | Marsh | |
| 7,210,887 | B2 | 5/2007 | Engert et al. | |
| 2003/0215309 | A1 * | 11/2003 | Engert et al. | 412/18 |
| 2008/0199276 | A1 * | 8/2008 | Graushar et al. | 412/4 |

* cited by examiner

*Primary Examiner* — Dana Ross
*Assistant Examiner* — Kyle Grabowski
(74) *Attorney, Agent, or Firm* — Davidson, Davidson & Kappel, LLC

(57) ABSTRACT

A cover applier is provided. The cover applier includes a transport system transporting a book, a cover delivery delivering a cover to a book, the cover delivery driven by a servomotor, a book sensor detecting an image printed on the book prior to the cover being delivered to the book and a cover sensor detecting an image printed on the cover prior to the cover being delivered to the book. The servomotor adjusting the position of the cover with respect to the book as a function of the book sensor and cover sensor. A method is also provided.

23 Claims, 3 Drawing Sheets

COVER APPLIER AND METHOD OF ALIGNING A BOOK IMAGE TO A COVER IMAGE

Priority is hereby claimed to U.S. Provisional Application No. 61/293,398 filed on Jan. 8, 2010 and hereby incorporated by reference herein.

BACKGROUND

The present invention relates generally to post press printing equipment and more particularly to binding books and applying covers to the books.

U.S. Pat. No. 7,210,887 purportedly discloses a bookbinding machine for processing inner books which includes a transport system with a multiplicity of inner-book clamps continually movable in a closed continuous track. The bookbinding machine also includes a plurality of workstations driven by a second motor which is independent of the motor that that drives the transport system.

U.S. Pat. No. 6,193,458 purportedly discloses a binder/trimmer in which a book block is placed in a carriage, jogged to align the pages and then transported to a milling station in which the spine of the book block is milled to roughen the spine, then to an adhesive application station at which a suitable adhesive is applied to the spine, and thence to a binding station at which the spine of the book is brought into engagement with the center portion of a cover and at which a binding clamp forces the cover against the outer faces of the book block proximate the spine and then to a trimming station.

U.S. Pat. No. 5,874,812 purportedly discloses a drive control system for a binding line having first and second separate binding-line segments which includes a first motor driving the first binding line segment and a second motor driving a the second binding-line segment, and a controller coupled to the first and second motors.

BRIEF SUMMARY OF THE INVENTION

The present invention provides a cover applier including a transport system transporting a book, a cover delivery delivering a cover to a book, the cover delivery driven by a servomotor, a book sensor detecting an image printed on the book prior to the cover being delivered to the book and a cover sensor detecting an image printed on the cover prior to the cover being delivered to the book. The servomotor adjusts the position of the cover with respect to the book as a function of the book sensor and cover sensor.

The present invention also provides a cover applier including a clamp transport system transporting a book, a cover delivery delivering a cover to a book, the cover delivery driven by a servomotor, a first book sensor detecting an image printed on the book, a second book sensor detecting an edge of the book or the clamp so a distance between the image printed on the book and the book edge or clamp can be determined, a third book sensor detecting the edge of the book or the clamp prior to the cover being delivered to the book and a cover sensor detecting an image printed on the cover prior to the cover being delivered to the book. The servomotor adjusts the position of the cover with respect to the book as a function of the first, second and third book sensors and cover sensor.

The present invention further provides a method for applying a cover to a book including the steps of moving a book to a cover delivery device, sensing a printed book image on the book, sensing a printed cover image on a cover, adjusting a position of the cover with respect to the book as function of the sensing of the book and cover and delivering the cover to the book.

BRIEF DESCRIPTION OF THE DRAWINGS

A preferred embodiment of the present invention will be elucidated with reference to the drawings, in which.

DETAILED DESCRIPTION OF PREFERRED EMBODIMENTS

Perfect binders or adhesive binders may use a cover applier to apply a cover to a glued book. The accuracy of the application of the cover critically affects the quality of the finished book. The print to cut register between signatures or books varies from one signature or book to the next, especially on web printed products. Thus, consistently applying the cover to the signature or book itself may still yield unsatisfactory results since the cover applier does not accommodate for variations in the print to cut register. For example, in some cases, a crossover image runs from the inside cover to the first page of the book block. Misalignment in this area may be very noticeable.

A servomotor was used previously to drive the cover applier in order to provide consistent cover edge to book registration. However, cover edge to book edge registration does not correct for variations in the print to cut register on the cover or book.

Figure 1:
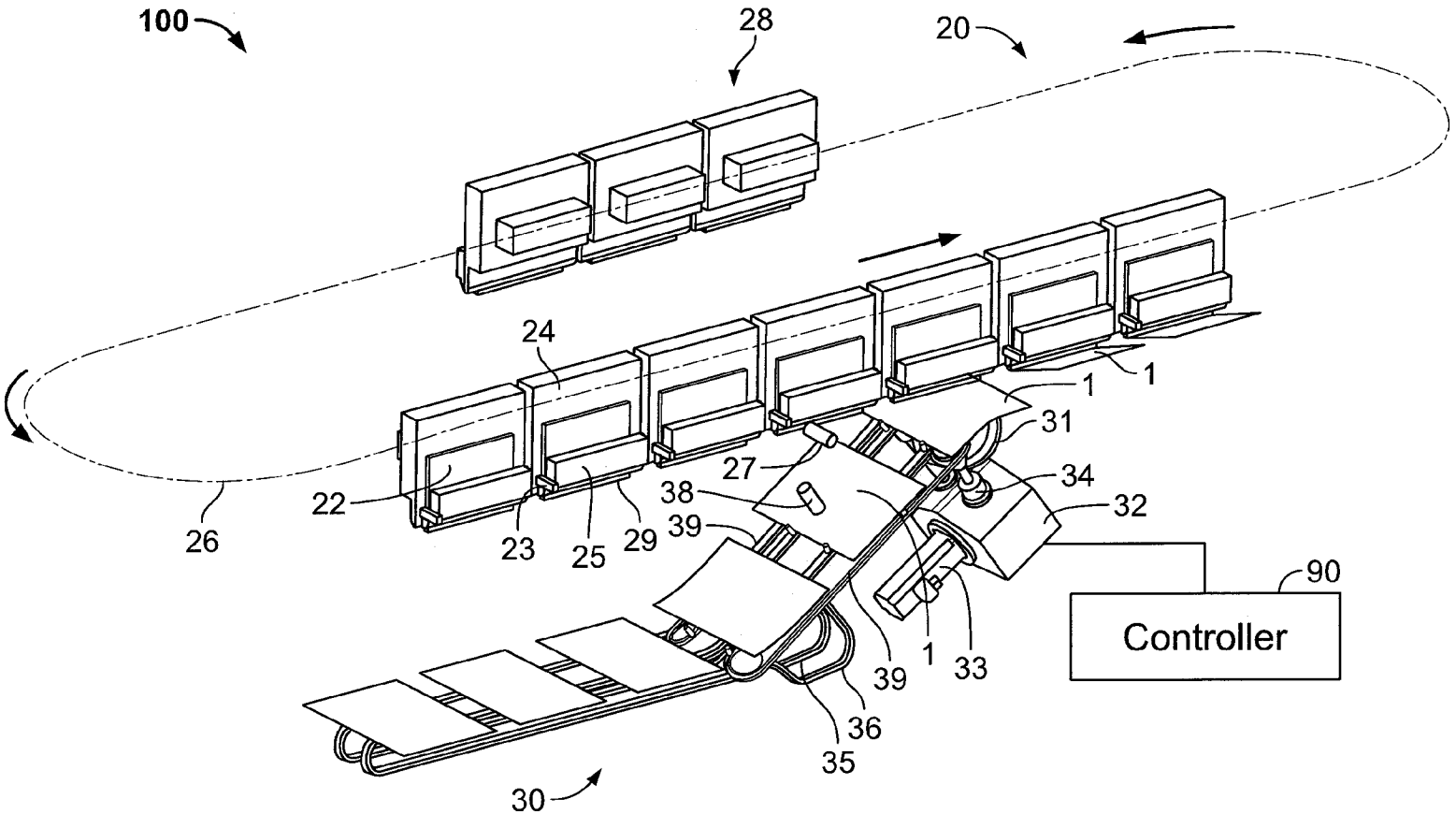
FIGS. 1 and 2 show a cover applier according to the present invention.

The present invention provides a cover applier which corrects for print to cut variations on the cover and/or book by accurately aligning a cover image to a book block image. FIG. 1 shows a preferred embodiment of a cover applier device 100 in accordance with the present invention including a clamp transport system 20, a cover delivery 30 and a controller 90.

Clamp transport system 20 includes a plurality of clamps 28 rotating around a clamp orbit path 26, which may be an endless conveyor and/or a closed continuous loop. Each clamp 28 includes a clamp mainframe 24, clamp pressure plate 25 and a clamp register pin 23. Book blocks 22 are aligned in clamp 28 by the register pin 23 and held between pressure plate 25 and mainframe 24. Book blocks 22 are transported along path 26 to cover delivery 30. Before reaching cover delivery 30, book blocks 22 may be transported past a milling station which removes folds in spines 29 of book blocks 22 if desired. After spines are milled, an optional side glue device may be used to apply side glue to the front and back pages of book block 22 adjacent to spine 29 which aides in producing a higher quality book. Glue is applied to spine 29 of each book block 22 via a glue applicator.

After glue is applied to spine 29, book blocks 22 are transported to cover delivery 30. Cover delivery 30 includes an applier drum 31, cover transport tapes 39, cover delivery chains 35, 36, a gearbox 32, servomotor 33 connected to controller 90 and a phasing device 34. Cover delivery 30 applies a cover 1 to book block 22 via drum 31 as shown in FIG. 1. Cover 1 is subsequently formed around spine 29 of book block 22 in a pressing station downstream. A further conveyor system then transports the book further downstream for trimming and distribution.

Figure 2:
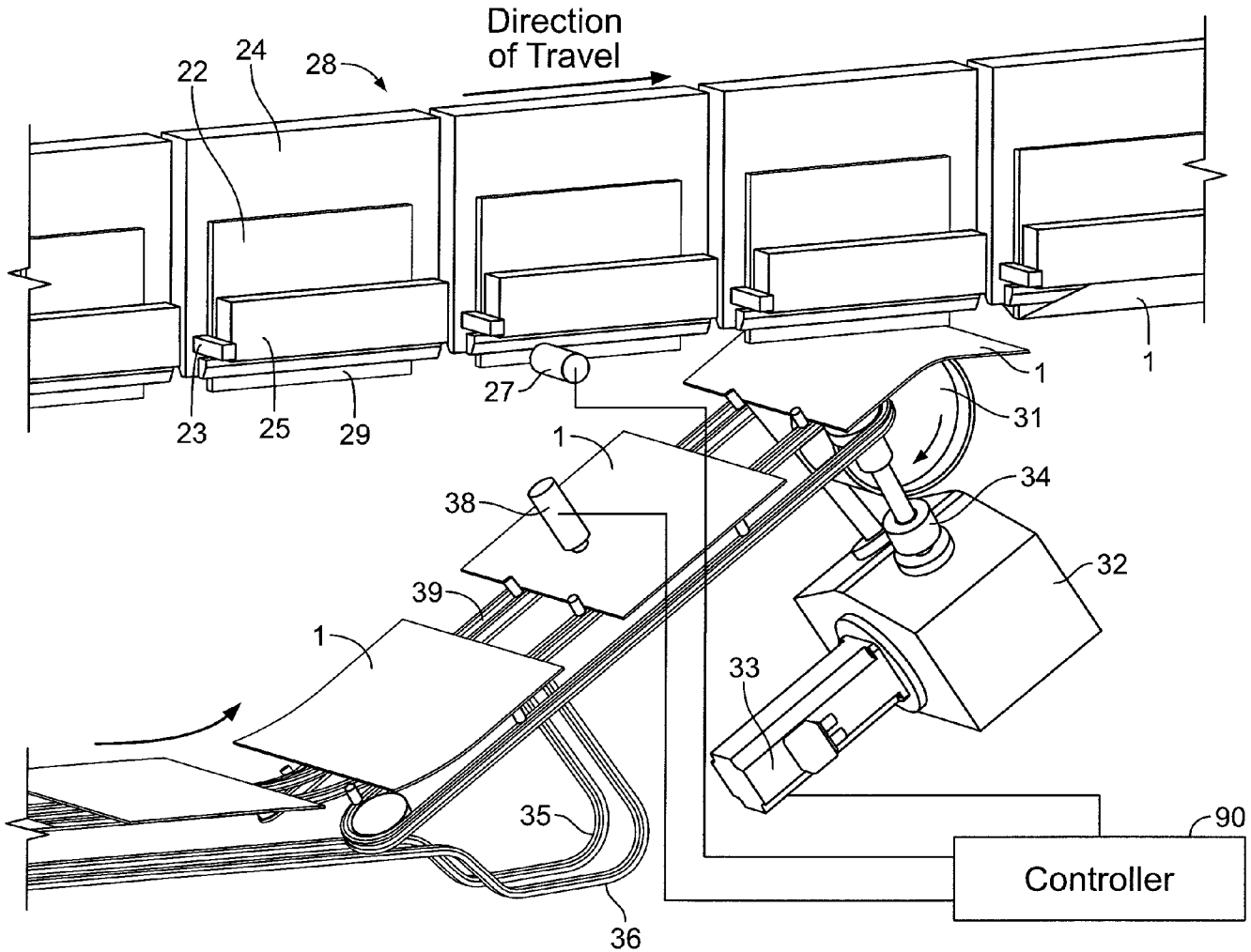

As shown in more detail in FIG. 2, a book block sensor 27 senses a specifically printed target, plurality of targets, or an image printed on book block 22. The specifically printed target may be, for example, a registration mark or a customized target. If an image is detected, the image may be the actual image printed for the book, for example, an image printed on a first page of book block 22 and for example include text and/or an image related to the contents of the book. Book block sensor 27 may be mounted either on the inside or outside of clamps 28 with respect to clamp conveyor 26 depending upon how book block 22 is laid out or transported in clamp 28. A second sensor, cover sensor 38, scans cover 1 at either a specifically printed target, plurality of targets or an image printed on cover 1. The cover target may be for example, a registration mark or a customized target. If a cover image is detected, the cover image may be the actual image printed on the cover for the book. Book block sensor 27 and cover sensor 38 are connected to controller 90. For any given job, an offset between sensor 27 and sensor 38 is constant. Controller 90 compares the given offset to the readings of sensors 27 and 38 to determine a correction value if necessary. The correction value is sent to servomotor 33 which compensates accordingly by controlling cover transport tapes 39 via gearbox 32.

Cover 1 is either advanced or retarded in order to compensate for the desired correction and match the image of the cover with the image of the book block. If a specifically printed target or targets are being used the cover targets are matched and/or aligned with the book block targets. A combination of including single or plural images and/or targets may also be used. When cover 1 reaches applier drum 31 the printed cover image (or cover target) will be aligned properly with the printed book image (or book target). An operator will be able to input the appropriate offset, to allow set up of the system on a per job basis. After the initial setup, a constant or variable adjustment may be automatically applied to each cover 1 as it is applied to each book block 22 to align the printed cover image with the printed book image properly.

FIG. 2 also shows a phasing device 34. Phasing device 34 may advance or retard cover transport tapes 39 to allow cover 1 to be deliberately skewed in order to compensate for covers that are not squarely delivered to the transport tapes 39. Adjustment by phasing device 34 may be made manually or via sensors on the fly. Phasing device 34 may also be connected to controller 90 as desired.

Figure 3:
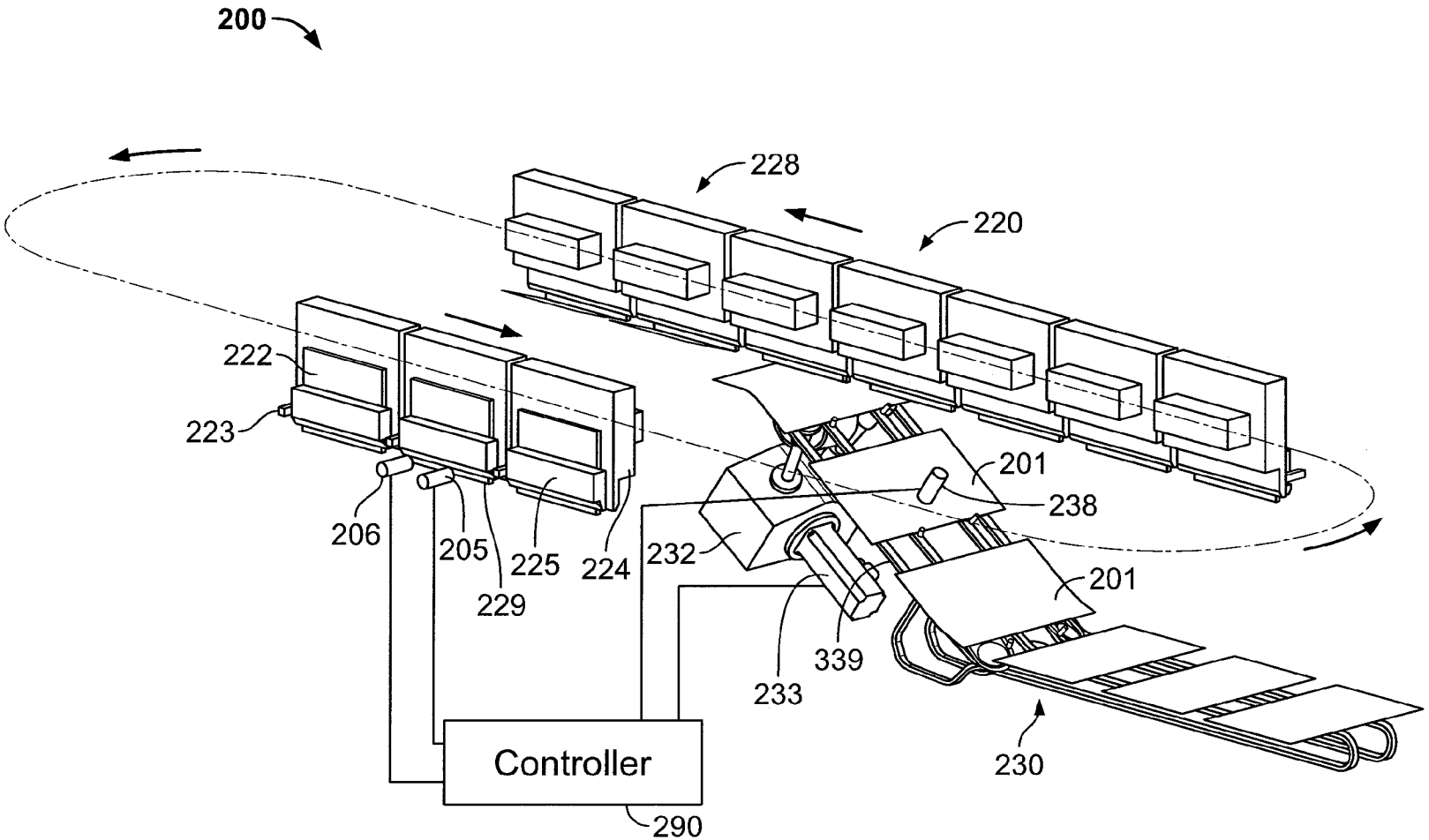
FIG. 3 shows another preferred embodiment of a cover applier in accordance with the present invention.

FIG. 3 illustrates another preferred embodiment of the present invention. A cover applier 200 including a clamp transport system 220, cover delivery 230 and controller 290 are shown. Clamp transport system 220, cover delivery 230 and controller 290 are similar to those shown and described in FIGS. 1 and 2. However, clamp transport system 220 includes two additional sensors, sensor 205 and sensor 206 which are also connected to controller 290. The application of side glue to a first and last page of a book block 222 may make reading a specifically printed target or printed image difficult. Book sensors 205, 206 are provided which detect a specifically printed target or targets or a printed image on book block 222 prior to side glue application. Sensors 205, 206 are located in a position on path 226 upstream of a side glue applicator. Sensor 205 can then detect a specifically printed target(s) or printed book image while sensor 206 detects an edge of the book block or clamp prior to glue being applied to the first or last page of book block 222. A location of the specifically printed target(s) or printed book image is then known with respect to clamp 228 or an edge of book block 222. Side glue can then be applied in a conventional manner.

Once cover image 201 or specifically printed target(s) are detected by sensor 238 prior to application of cover 201 to book block 222, a sensor (similar to sensor 27 shown in FIGS. 1 and 2) detects the book block edge or clamp 228. Controller 90 compares these values to the values obtained from sensors 205 and 206 to determine the amount of advance or retard required to match the printed cover image with the printed book image as discussed above with respect to FIGS. 1 and 2.

The embodiment shown in FIG. 3 may be used with or without a side glue applicator if desired. A phasing device similar to phasing device 34 may also be used with the FIG. 3 embodiment in order to advance or retard cover transport tapes 339 as desired to compensate for skew for covers that are supplied out of square.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A cover applier comprising:

a transport system transporting a book;

a servomotor;

a cover delivery delivering a cover to a book, the cover delivery driven by a the servomotor;

a book sensor detecting an image printed on the book prior to the cover being delivered to the book; and a cover sensor detecting an image printed on the cover prior to the cover being delivered to the book;

a book edge sensor detecting an edge of the book prior to the cover being delivered to the book;

a controller, the controller connected to the servomotor, the book sensor, the cover sensor, and the book edge sensor, the controller adjusting the position of the cover with respect to the book by driving the servomotor as a function of the book sensor, book edge sensor, and cover sensor.

2. The cover applier as recited in claim 1 wherein the image printed on the book is a printed target or a plurality of printed targets.

3. The cover applier as recited in claim 1 wherein the image printed on the cover is a printed target or a plurality of printed targets.

4. The cover applier as recited in claim 1 wherein the image printed on the cover is an actual image for the cover.

5. The cover applier as recited in claim 1 wherein the image printed on the book is an actual image for the book.

6. The cover applier as recited in claim 1 further comprising a gearbox connected to the servomotor.

7. The cover applier as recited in claim 1 wherein the transport system is a clamp transport system that includes a plurality of clamps transported along an endless conveyor or closed continuous loop.

8. The cover applier as recited in claim 7 wherein each clamp includes a clamp mainframe, a pressure plate and a register pin.

9. The cover applier as recited in claim 1 further comprising a phasing device adjusting skew in during transport of the cover in the cover delivery.

10. The cover applier as recited in claim 1 wherein the cover delivery includes cover delivery chains, transport tapes and an applier drum.

11. The cover applier as recited in claim 1 wherein the servomotor advances or retards the cover delivery to match the position of the cover with respect to the book.

12. A method for applying a cover to a book comprising the steps of:

securing a book on a clamp transport system with a clamp;

moving the book on the clamp transport system along a path to a cover delivery device;

sensing a printed book image on the book at a first location along the path;

sensing an edge of the book or the clamp at the first location;

sensing a printed cover image on a cover;

sensing the edge of the book or the clamp at a second location along the path and before the cover is delivered to the book, the second location downstream of the first location;

adjusting a position of the cover with respect to the book as a function of the sensing of the book image, the cover image, the book edge at the first location, and the book edge at the second location; and delivering the cover to the book.

13. The method of claim 12, wherein the step of adjusting includes determining a distance between the book image on the book and the book edge or clamp as a function of the sensing of the book image at the first location and the sensing of the book edge at the first location.

14. The method of claim 13, wherein the step of adjusting including adjusting the position of the cover with respect to the book as a function of the sensing of the cover image, the book edge at the second location, and the distance determined from the sensing of the book image at the first location and the sensing of the book edge at the first location.

15. The cover applier of claim 13, wherein the step of adjusting including adjusting the position of the cover with respect to the book as a function of the sensing of the cover image, the book edge at the second location, and the distance determined from the sensing of the book image at the first location and the sensing of the book edge at the first location.

16. The method of claim 12, further comprising applying glue to a first or a last page of the book with a side glue applicator at a third location along the path, the third location downstream of the first location and upstream of the second location.

17. The method of claim 16, wherein the step of adjusting includes determining a distance between the book image on the book and the book edge or clamp as a function of the sensing of the book image at the first location and the sensing of the book edge at the first location.

18. A cover applier comprising:

a clamp transport system transporting a book along a path;

a servomotor;

a cover delivery delivering a cover to a book, the cover delivery driven by a the servomotor;

a first book sensor detecting an image printed on the book;

a second book sensor detecting an edge of the book or the clamp, the first book sensor and the second book sensor located at a first location along the path;

a third book sensor detecting the edge of the book or the clamp prior to the cover being delivered to the book, the third book sensor located downstream of the first location;

a cover sensor detecting an image printed on the cover prior to the cover being delivered to the book;

a controller coupled to the servomotor, the cover sensor, the first book sensor, the second book sensor and the third book sensor, the controller adjusting the position of the cover with respect to the book by driving the servomotor as a function of the first, second and third book sensors and the cover sensor.

19. The cover applier as recited in claim 18 further comprising a side glue applicator applying glue to a first or a last page of the book, the side glue applicator located downstream of the second book sensor and upstream of the third book sensor.

20. The cover applier of claim 19, wherein the controller determines a distance between the image printed on the book and the book edge or clamp as a function of the first and second book sensors.

21. The cover applier of claim 20, wherein the controller adjusts the position of the cover with respect to the book by driving the servomotor as a function of the third book sensor, the cover sensor, and the distance determined from the first and second book sensors.

22. The cover applier of claim 18, wherein the controller determines a distance between the image printed on the book and the book edge or clamp as a function of the first and second book sensors.

23. The cover applier of claim 22, wherein the controller adjusts the position of the cover with respect to the book by driving the servomotor as a function of the third book sensor, the cover sensor, and the distance determined from the first and second book sensors.

* * * * *